US005140793A

United States Patent [19]

Knudson

[11] Patent Number: 5,140,793

[45] Date of Patent: Aug. 25, 1992

[54] SNAP-ON POSITIVE SNAP-LOCK PANEL ASSEMBLY

[76] Inventor: Gary A. Knudson, 17356 W. 57th Ave., Golden, Colo. 80401

[21] Appl. No.: 684,825

[22] Filed: Apr. 15, 1991

[51] Int. Cl.[5] ..... E04D 3/363

[52] U.S. Cl. ..... 52/520; 52/588

[58] Field of Search ..... 52/520, 545, 588, 522, 52/529, 530, 542; 29/453, 525

[56] References Cited

U.S. PATENT DOCUMENTS

| | | | |
|---|---|---|---|
| 892,248 | 6/1908 | Garvin | 52/529 |
| 1,706,924 | 3/1929 | Kane | 52/529 |
| 3,559,359 | 2/1971 | Talbert | 52/522 |
| 4,091,588 | 5/1978 | Heirich | 52/522 |
| 4,570,404 | 2/1985 | Knudson | 52/520 |
| 4,878,331 | 11/1989 | Taylor | 52/519 |

FOREIGN PATENT DOCUMENTS

| | | | |
|---|---|---|---|
| 284855 | 10/1966 | Australia | 52/588 |
| 1336774 | 9/1963 | France | 52/529 |

*Primary Examiner*—James L. Ridgill, Jr.
*Attorney, Agent, or Firm*—Fields, Lewis, Pittenger & Rost

[57] ABSTRACT

A panel assembly and panel disclosed have male and female joint portions and a hold-down member that anchor the male joint portion arranged so that the female joint portion snap fits down over the hold-down member and male joint portion to provide a positive snap-lock and yet allows for unevenness in the support surface and holds firmly against upward forces pulling the panels apart at the joint as by wind.

7 Claims, 1 Drawing Sheet

SNAP-ON POSITIVE SNAP-LOCK PANEL ASSEMBLY

TECHNICAL FIELD

This invention relates to a novel and improved snap-on panel assembly that has a positive lock and is anchored to a support such as a roof board.

BACKGROUND ART

Sheet metal panels with flanged edges and panel assemblies that are seam connected have heretofore been used in buildings to form roofing, mansard, fascia, siding and the like. A two-part hold-down device for a panel assembly is disclosed in U.S. Pat. No. 4,570,404 having the same inventor as the present invention.

Garvin U.S. Pat. No. 892,248 discloses a roofing panel having an upstanding side wall along one side and the other side wall formed with a downturned hook-like portion forming a female joint portion and one fits over the one upstanding side wall with the upstanding side wall being anchored to the roof by a hold-down clip.

Taylor U.S. Pat. No. 4,878,331 discloses a metal roof structure in which one inverted channel-shaped member along the side of a panel slides over another inverted channel-shaped member of an adjacent panel with a snap fit joint connecting the panels together.

DISCLOSURE OF INVENTION

A snap-on positive snap-lock panel assembly has two similar panels arranged side by side on a support with one side wall of one panel formed with a male joint portion anchored to the support by a hold-down member. The male and a female joint portions formed in the adjacent side wall portions along with the hold-down member snap together at a snap joint to become positively snap-locked. The male joint portion includes an inturned offset section and an upstanding end section. The female joint portion formed with the other side wall portion includes an outer wall section spaced from the associated side wall portion and connected at a top rounded bend with the outer wall section having an inturned end section defining a bottom slot. The bottom slot of the female joint portion fits down over the upstanding portion of the hold-down member and male joint portion and the female joint portion snap fits under a depending section of the hold-down section spaced below the offset section with some space between the offset section and the inturned end section to accommodate unevenness of the top surface of the support. This construction minimizes the ability of the panels to be pulled apart as by an uplift by wind or the like.

BRIEF DESCRIPTION OF THE DRAWINGS

Details of this invention are described in connection with the accompanying drawings which like parts bear similar reference numerals in which.

DETAILED DESCRIPTION

Figure 1:
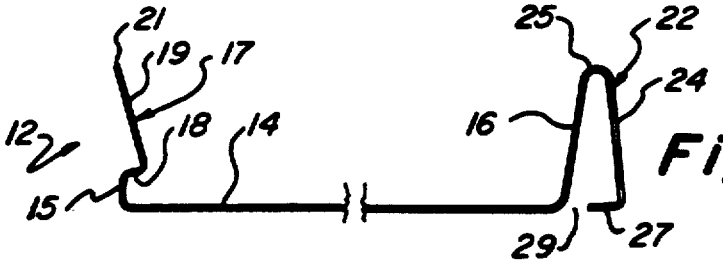
FIG. 1 is an end elevation view of a snap-on positive snap-lock panel embodying features of the present invention.
Figure 3:
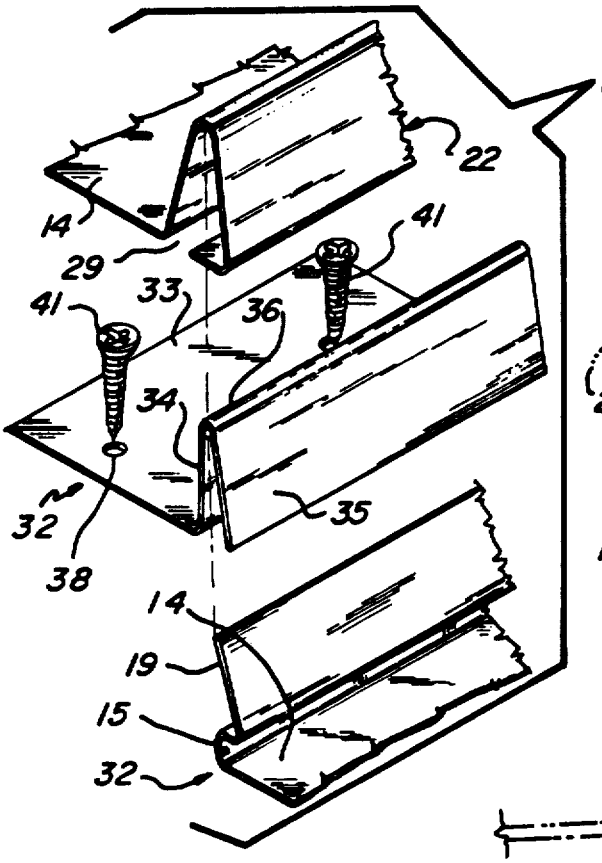
FIG. 3 is an exploded view of the panel assembly shown in FIG. 2.

Referring now to FIGS. 1-4, there is shown a panel and panel assembly embodying features of the present invention. Each panel 12 shown includes a bottom wall 14 and a pair of upstanding side wall portions 15 and 16 at opposite longitudinal edges of the bottom wall. The side wall portion 15 has a male joint portion 17 which includes an inwardly extending offset section 18 and an upwardly and outwardly extending upper section 19 terminating at the top in a terminal top edge 21. The offset section 18 then extends laterally in and in a plane a selected distance above and parallel to the bottom wall 14. This spacing is sufficient to receive the inturned end section and allow for unevenness of the supporting surface hereinafter described.

The side wall portion 16 has a female joint portion 22 which includes an outer wall section 24 spaced from side wall portion 16 and connected thereto by a rounded bend 25. The side wall portion 16 and opposite depending side wall section 24 preferably diverge downwardly away from each other at a slight angle on the order of three degrees as shown. An inturned end section 27 extends inwardly from the lower end of the outer wall section 24 and terminates in an inwardly facing terminal edge 28. The inturned end section 27 and associated bottom wall 14 are in substantially the same plane. A bottom slot 29 is formed between the terminal edge 28 and the longitudinal edge of the bottom wall 14 at the base of wall portion 16.

A clip or hold-down member 32 shown includes a flat base 33, a first side wall portion 34 extending up from one longitudinal edge of the base with a top hook portion 36 and a downwardly extending depending second side wall portion 35 connected at the top of wall portion 34 and at a top rounded bend that forms the top hook portion 36. The hold-down member hooks over the top terminal edge 21 of the upper section 19 of the male joint portion of the first panel and the base 33 is fastened to a support 39 such as a roof board by means of a screw 41 preferably with a tapered head or the like that extends through an aperture 38 in the base and threads into the support 39 to anchor the side wall portion 17 of the panel to the support. The width of the bottom slot 29 is greater than the width of the top hook portion 36 to enable the slot to slidably receive the top hook portion. The width of the bottom slot 29 is substantially less than the width of the hold-down member at the base of the hold-down member so the female joint portion flexes to widen the bottom slot and the inturned terminal section will snap under the bottom edge 37 once section 27 moves past edge 37.

Figure 2:
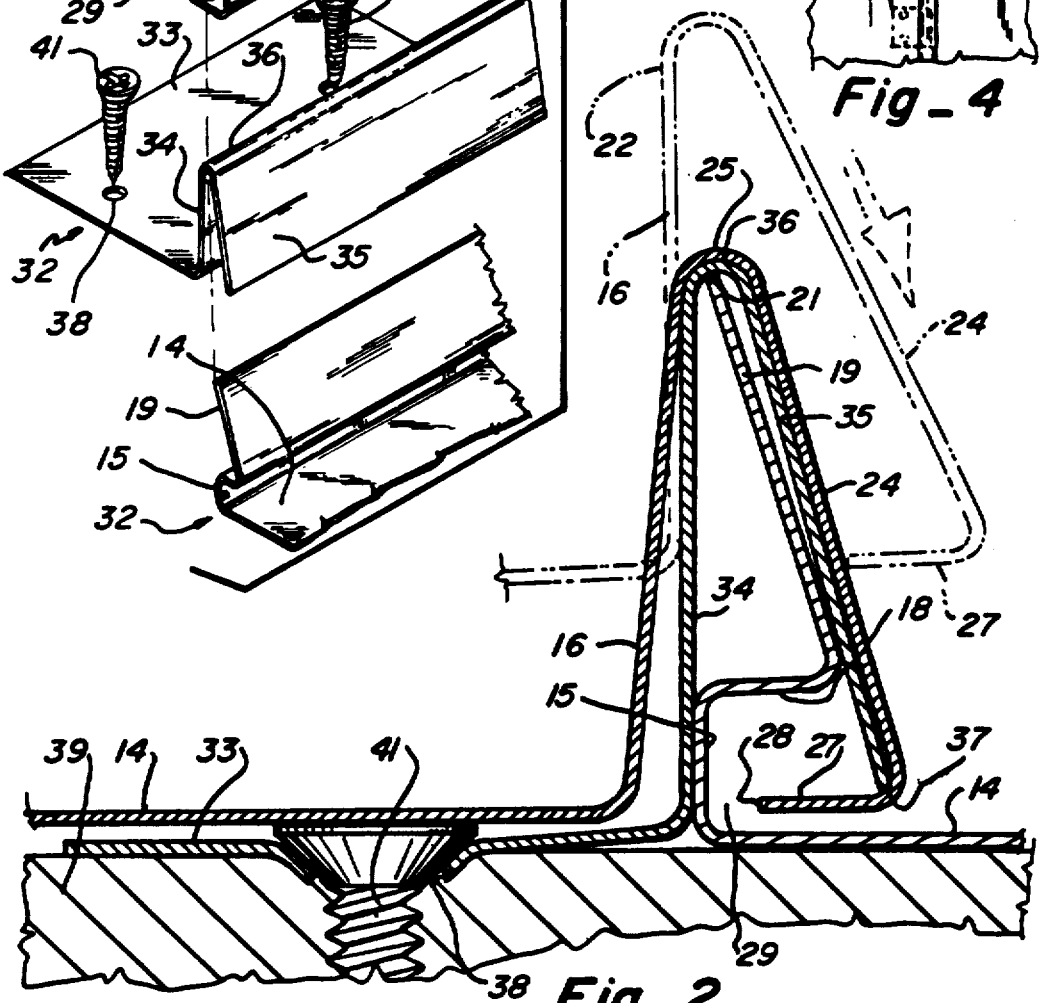
FIG. 2 is a cross-sectional view of an assembly of two of the panels shown in FIG. 1 that are anchored to a support.

To assemble a second panel to an anchored first panel the bottom slot 29 of the female joint portion 22 of a second panel 12 is inserted down over the upstanding portion of the hold-down member and side wall portion 17 of the anchored panel with the terminal edge 28 of the second panel sliding against the wall portion 35 and wall section 17 and side wall portion 16 sliding against side wall portion 34. The outer wall section 24 and the associated side wall portion 16 spreads apart to widen the bottom slot with inturned end section 27 moving under the edge 37 of the hold-down member and under and in spaced relation to offset section 18 of the second panel due to the resiliency of the sheet metal with which the panels are typically made. In this way the female joint portion 22 of the second panel will snap fit over the hold-down member 32 and male joint portion 17 of the anchored first panel and form a positive lock. The plane of the bottom wall of the anchored panel is slightly above the plane of the second panel to allow for the thickness of the base 33 and at least a portion of the fastener head of the fastener 41 as seen in FIG. 2. The offset section 18 shown extends laterally out and may extend up from the horizontal at a slight angle which may be 10 to 15 degrees but no more than about 20 degrees. The inturned end section 27 extends inwardly from the lower end of the outer wall section. With this arrangement, the ability of said panel to be pulled up and out when an upward force is applied thereto without deforming the inturned end portion is minimized.

Figure 4:
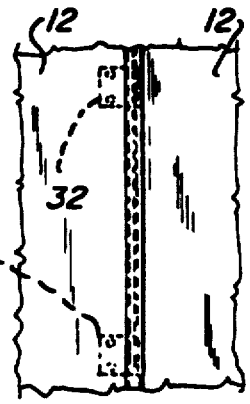
FIG. 4 is a plan view of the panel assembly showing two panels and two spaced hold-down members.

In a panel assembly as shown in FIG. 4 the hold-down members 34 are relatively short in comparison to the length of the panels and are located at spaced intervals along the connected panels such as three feet apart. Typically, the support 39 has an uneven top surface and the above arrangement of having the depending wall section 35 extend substantially below the offset section 18 affords significant flexure of the connected panels at the joints to allow for top surface unevenness, lack of flatness, undulations, and projections typically found on roof board surfaces. Therefore, the gap or spacing between section 18 and section 27 will vary considerably along the length of the joint and in some cases between hold-down members section 27 may actually butt against section 18.

The snap-lock joint between the panels of having inturned terminal section 27 below offset section 18 extends the full length of the panels. The engagement of the inturned terminal section 27 against the edge 37 of each hold-down member 32 takes the play or looseness out of the assembly and the hold-down member can bend to allow for surface unevenness, etc. Upward forces applied to pull the panels apart at the joint has a first line of engagement with the hold-down members and a second line of engagement with the offset section. In any event, the only way the panels will come apart due to upward forces by wind would be to have the inturned end section 27 deform toward straightening out and this is unlikely with the thickness of the sheet metal being used.

Although the present invention has been described with a certain degree of particularity, it is understood that the present disclosure has been made by way of example and that changes in details of structure may be made without departing from the spirit thereof.

What is claimed is:

1. In a snap-on panel assembly, the combination comprising:

a pair of similar snap-on panels disposed side-by-side on a support, each said panel having a bottom wall and a pair of upstanding side wall portions, one upstanding side wall portion of one of said panels having a male joint portion including an inwardly extending offset section and including an upwardly extending upper section, a hold-down means for securing said one side wall portion to said support, said hold-down means including a base secured to said support, a first side wall portion extending up from said base with a top hook portion that is hooked over the top of said upper section, and a depending second side wall portion extending down from said top hook portion over said upper section and terminating in a bottom edge below said offset section, an adjacent upstanding side wall portion of the other of said panels having a female joint portion including a depending outer wall section spaced from and connected at the top to the top of said side wall portion of said other panel and extending downwardly therefrom and an inturned end section extending inwardly from the lower end of said depending outer wall section to form a bottom slot, said hold-down means increasing in width from an upper part to a lower part, the width of said bottom slot being greater than the width of said upper part to enable said female joint portion to slide down over said hold-down means and spread until said inturned terminal section is below said bottom edge, said female joint portion contracting with said inturned edge extending under and against said bottom edge to form a primary snap lock and under said offset section as a secondary snap lock if said primary snap lock does not hold to positively lock said panels together and resist an upward force tending to pull said panels apart.

2. In a snap-on panel assembly as set forth in claim 1 wherein said hold-down means includes a plurality of spaced clip-like hold-down members that are relatively short in comparison to the length of said panels, said hold-down members being disposed at selected distances apart along said panels.

3. In a snap-on panel assembly as set forth in claim 1 wherein said offset section extends laterally in and in a plane a selected distance above and substantially parallel to the plane of the associated bottom wall.

4. In a snap-on panel assembly as set forth in claim 1 wherein said inturned end section extends substantially parallel to and is substantially in the plane of the associated bottom wall.

5. In a snap-on panel assembly as set forth in claim 1 wherein said other side wall portion and said depending second side wall section diverge downwardly away from each other from said top hook portion at a slight angle.

6. In a snap-on panel assembly as set forth in claim 1 wherein the bottom wall of said one panel is slightly above the plane of the bottom wall of the other panel to allow space for said base and a fastener head of a fastener extending down through said base into said support.

7. In a snap-on panel assembly adapted to form a locking joint at adjacent longitudinal edges of a pair of said panels, each said panel having a bottom wall and a pair of upstanding side wall portions at opposite longitudinal edges of said bottom wall, the combination comprising:

one of said side wall portions having a male joint portion including an inwardly extending offset section a selected distance above said bottom wall and an upwardly and outwardly extending upper section terminating in a first terminal edge, a hold-down means for securing said one side wall portion to said support, said hold-down means including a base secured to said support, a first side wall portion extending up from said base with a top hook portion that is hooked over the top of said upper section, and a depending second side wall portion extending down from said top hook portion over said upper section and terminating in a bottom edge, an adjacent upstanding side wall portion of the other of said panels having a female joint portion including a depending outer wall section spaced from and connected at the top to the top of said side wall portion of said other panel and extending downwardly thereto and an inturned end section extending inwardly from the lower end of said depending outer wall section to form a bottom slot, said hold-down means increasing in width from an upper part to a lower part, the width of said bottom slot being greater than the width of said upper part to enable said female joint portion to slide down over said hold-down means and spread until said inturned terminal section is below said bottom edge, said female joint portion contracting with said inturned edge extending under and against said bottom edge to form a primary snap lock and under said offset section as a secondary snap lock if said primary snap lock does not hold to positively lock said panels together with the ability of said other panel to be pulled apart when an upward force is applied to said other panel without deforming said inturned end portion is minimized.

* * * * *